US009898916B2

(12) United States Patent
Valleru

(10) Patent No.: US 9,898,916 B2
(45) Date of Patent: Feb. 20, 2018

(54) ALARM SYSTEM

(71) Applicant: Nabors Drilling Technologies USA, Inc., Houston, TX (US)

(72) Inventor: Sri Valleru, Spring, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 15/075,812

(22) Filed: Mar. 21, 2016

(65) Prior Publication Data

US 2017/0270768 A1 Sep. 21, 2017

(51) Int. Cl.
*G08B 21/18* (2006.01)

(52) U.S. Cl.
CPC ..... *G08B 21/18* (2013.01)

(58) Field of Classification Search
CPC . A61L 9/035; A61L 2209/11; B01D 2257/90; B01D 53/30; G08B 21/14; G08B 21/16; G08B 21/18
See application file for complete search history.

(56) References Cited

U.S. PATENT DOCUMENTS 4,407,585 A 10/1983 Hartford et al.
6,628,204 B1 * 9/2003 Ito ..... G09B 9/00 340/691.2
6,881,382 B2 4/2005 Goldstein et al.
7,528,732 B2 5/2009 Tajima et al.
7,914,468 B2 3/2011 Shalon et al.
8,269,640 B2 9/2012 Ueno et al.
2010/0308995 A1 12/2010 Goto et al.
2011/0089255 A1 4/2011 Kolich
2012/0024042 A1 * 2/2012 Vass ..... G01N 33/0031 73/23.34
2014/0311219 A1 * 10/2014 Brasfield ..... G01N 33/0004 73/23.34
2015/0053482 A1 * 2/2015 Boone ..... E21B 41/0092 175/24
2015/0297778 A1 * 10/2015 Conroy ..... B05B 7/2424 239/11

* cited by examiner

*Primary Examiner* — Curtis Odom
(74) *Attorney, Agent, or Firm* — Enrique Abarca; Abel Law Group, LLP

(57) ABSTRACT

A system including a working environment and a control center separated from the working environment and configured to monitor systems in the working environment, the control center having an odor alarm system configured to deliver at least a first odor to the control center and alert an operator to an alert condition. In an embodiment, the odor alarm system is configured to deliver a second odor associated with a second alarm condition, wherein the first alarm condition is different than the second alarm condition. In an embodiment, the odor alarm system is configured to be used in conjunction with the one or more visual or audio alarm systems.

20 Claims, 2 Drawing Sheets

ALARM SYSTEM

FIELD OF THE DISCLOSURE

The present invention relates to alarm systems, and more particularly, to odor alarm systems.

RELATED ART

Alert systems typically include one or more sensors monitoring an environment for a sensible condition. Upon occurrence of the sensible condition an alert is generated and relayed to an operator in a visual or auditory manner.

Various industries continue to demand improved alert systems.

BRIEF DESCRIPTION OF THE DRAWINGS

Embodiments are illustrated by way of example and are not intended to be limited in the accompanying figures.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the alarm generating system arts.

Figure 1:
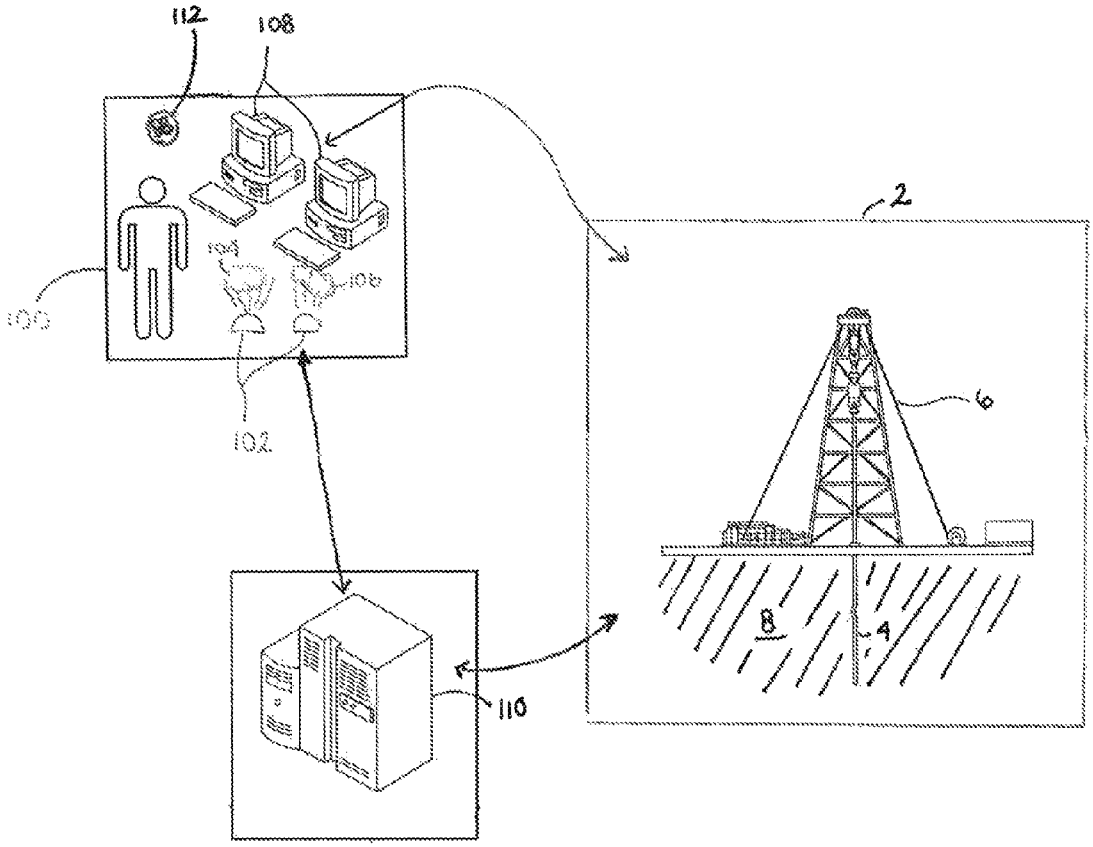
FIG. 1 includes a schematic view of an alarm system in accordance with an embodiment.

Referring initially to FIG. 1, a working environment 2 may include an industrial working site such as a subterranean operation 4 including, for example, a drilling rig 6. The drilling rig 6 may perform drilling activities in the working environment 2, such as forming a wellbore in a subterranean structure 8. Other working environments 2 include construction sites, industrial factories, mining operations, and other similar environments having high noise or low visibility where sound or vision based alerts are not practical or sufficient to properly alert a user of a condition. In an embodiment, the working environment 2 includes a substantially automated industrial work site. That is, the industrial work site may include automated aspects and features. In a further embodiment, the working environment 2 may include a fully automated industrial work site.

A control center 100 can be separated from the working environment 2 and configured to monitor systems in the working environment 2. In an embodiment, the control center 100 can be remotely located from the working environment 2. For example, the control center 100 may be located a distance from the working environment 2. In a particular embodiment, the control center 100 may be located in a different country than the working environment 2. In an embodiment, the control center 100 may be near the working environment 2. For example, the control center 100 may be housed in a transportable housing positioned adjacent to the working environment.

In an embodiment, the control center 100 may be in the working environment. For example, the control center 100 may be an enclosed cabin, e.g., a controller box, on the drilling rig 6.

In an embodiment, the control center 100 can be a virtual monitoring center configured to monitor the actions of the working environment 2. In a particular embodiment, virtual monitoring can occur via a wireless communication protocol. Wireless communication can include communication of a transferable format and protocol based on the industry WITSML format, using XML as a data format and web services over HTTPS. In another embodiment, information can be transferred directly to the control center 100 by wiring or by another non-wireless local communication system, such as a LAN. It will be appreciated that any portion of the communication protocol between any of the components of the embodiments herein can use wireless, wired, or a combination of wireless and wired communication. For example, the control center 100 can be configured to monitor the actions of the working environment via a wired communication. In such instances, the control center 100 may be located on or nearby the working environment, such as on the drilling rig 6, as noted above.

The control center 100 may include a virtual display of actions in the working environment 2. Monitoring elements such as monitors, gauges, and auditory alarms may cue the control center operators to changing conditions in the working environment 2. In an embodiment, the control center operators can respond to the monitors, gauges, and auditory alarms by adjusting parameters within the working environment 2. These control parameters may be delivered to the working environment via a wireless or wired communication protocol.

In subterranean operations 4 the monitored systems in the working environment 2 may include mud pumps, top drives, pressurized systems, detection systems, power generating units such as engines, or any combination thereof. The systems may be disposed directly on the drilling rig 6 or at a location spaced apart therefrom, including for example, systems positioned separately from the drilling rig 6 and in communication with the drilling rig 6.

Upon occurrence of an alert condition, e.g., a critical condition or a dangerous condition, to the system, an odor alarm system 102 can deliver at least a first odor 104 to the control center 100. Delivery of the first odor 104 to the control center 100 may alert an operator to the occurrence of the alert condition at the working environment 2.

In an embodiment, the first odor 104 can be associated with a first alarm condition. The first odor 104 may be selected from the group of a pleasant odor or an unpleasant odor. For example, the unpleasant odor may include sulfuric compositions simulating a rotten egg, while the pleasant odor may include, for example, lavender, sage, or mint. In an embodiment, the first odor 104 may have a scent indicative of the first alarm condition. For example, the first odor 104 may simulate the scent of natural gas for a gas pressure problem or petroleum flue for fuel leaks.

In an embodiment, the odor alarm system 102 may further include a second odor 106. The second odor 106 may be associated with occurrence of a second alarm condition different than the first alarm condition. For example, the first odor 106 may be delivered upon occurrence of a pressure drop within one of the monitored systems whereas the second odor may be delivered upon occurrence of a critical temperature in one of the monitored systems. Similar to the first odor 104, the second odor may have a scent indicative of the second alarm condition. The first and second odors 104 and 106 may be different from one another, such that an operator can decipher the different alert conditions based on their different odor types.

In an embodiment, the odor alarm system 102 may be configured to deliver one of a select volume of the first odor 104, a select concentration of the first odor 104, or a rate of the first odor 104 based upon at least one of an urgency criterion associated with the alarm condition, a duration criterion associated with the alarm condition, and a repetition criterion associated with the alarm condition. Urgency, duration, or repetition criterion of the alert condition can be communicated to an operator through select concentration, volume, or rate of the first odor 104 in the control center 100. Relatively high concentrations, volumes, or rates of the first odor 104 may suggest increased urgency, duration, or repetition of the alarm condition. For example, the first odor 104 may have a first concentration, volume, or rate for a first urgency, duration, or repetition criterion and a second concentration, volume, or rate for a second urgency, duration, or repetition criterion. The first urgency, duration, or repetition criterion may be different than the second urgency, duration, or repetition criterion and the first concentration, volume, or rate may be different than the second concentration, volume, or rate. Operators can assess the relative urgency, duration, or repetition of the alarm condition by the discernable concentration, volume, or rate of the first odor 104 within the control center 100. In an embodiment, the odor alarm system 102 may be configured to deliver one of a select volume of the second odor 106, a select concentration of the second odor 106, or a rate of the second odor 106 based upon at least one of an urgency criterion associated with the alarm condition, a duration criterion associated with the alarm condition, and a repetition criterion associated with the alarm condition. Urgency, duration, or repetition criterion of the alert condition can be communicated to an operator through select concentration, volume, or rate of the second odor 106 in the control center 100. Relatively high concentrations, volumes, or rates of the second odor 106 may suggest increased urgency, duration, or repetition of the alarm condition. For example, the second odor 106 may have a first concentration, volume, or rate for a first urgency, duration, or repetition criterion and a second concentration, volume, or rate for a second urgency, duration, or repetition criterion. The first urgency, duration, or repetition criterion may be different than the second urgency, duration, or repetition criterion and the first concentration, volume, or rate may be different than the second concentration, volume, or rate. Operators can assess the relative urgency, duration, or repetition of the alarm condition by the discernable concentration, volume, or rate of the second odor 106 within the control center 100. The invention is not intended to be limited to two odors. Rather, it will be appreciated that any number of odors can be used to communicate any number of alarm conditions to an operator. For example, the odor alarm system 102 may be configured to deliver at least three odors, at least four odors, at least five odors, or even at least ten odors.

In an embodiment, the odor alarm system 102 can include at least one odor-containing capsule configured to contain the first odor, a delivery mechanism configured to deliver the first odor to the control center 100, and a controller 110 coupled to the odor alarm system and a monitoring system. The controller 110 may be configured to transmit an odor delivery signal to the odor alarm system 102 upon receiving an alarm condition from the monitoring system. The at least one odor-containing capsule may then release at least one of the first odor 104 and second odor 106, which is to be dispersed by the delivery mechanism into the control center 100.

By way of a non-limiting example, one or more monitoring elements positioned at the worksite 2 relay 114 signals to the controller 110 relating to the condition of equipment at the worksite 2. Upon receipt of the signal, the controller 110 analyzes the condition and determines whether an alert condition has occurred. The controller 110 then generates and transmits an odor delivery signal 116 to the odor alarm system 102 in the control center 100 to alert an operator.

In an embodiment, relaying of the signal 114 from the worksite 2 to the controller 110 can occur via a wireless communication protocol. Wireless communication can include communication of a transferable format and protocol based on the industry WITSML format, using XML as a data format and web services over HTTPS. In another embodiment, the signal 114 can be transferred directly to the controller 110 by wiring or by another non-wireless local communication system, such as a LAN.

In an embodiment, transmission of the odor delivery signal 116 to the control center 100 can occur in a manner similar to relaying of signal 114 to the controller 110. For example, transmission of the odor delivery signal 116 can occur via a wireless communication protocol. Wireless communication can include communication of a transferable format and protocol based on the industry WITSML format, using XML as a data format and web services over HTTPS. In another embodiment, information can be transferred directly to the control center 100 by wiring or by another non-wireless local communication system, such as a LAN.

In a particular embodiment, the control center 100 can further include at least one of an audio alarm system and a visual alarm system 108. The odor alarm system 102 may be configured to work in conjunction with the audio or visual alarm systems 108. In such a manner, the first alarm condition can cause delivery of the first odor in the control center 100 in conjunction with an auditory or visual alarm. In an embodiment, the controller 110 can be in communication with the audio or visual alarm systems 108 via wireless or non-wireless communication protocol. In delivering the odor delivery signal 116 to the odor alarm system 102, the controller 110 can also communicate with the audio or visual alarm systems 108, generating an alarm signal in the control center 100.

In a more particular embodiment, the odor alarm system 102 may be activated only after a failure signal is generated by the controller for failure of an operator to respond to at least one of the visual alarm and audio alarm. That is, the odor alarm system 102 may operate as a backup alarm system when the auditory or visual alarm is not addressed in a timely manner by the operator. In an embodiment, delivery of the first or second odors 104 or 106 may be delayed by a predetermined time from engagement of the auditory or visual alarm. That is, the controller 110 may include present logic affecting delivery of the first or second odors 104 or 106 a predetermined time after engaging the auditory or visual alarm.

The system may further include a neutralization system 112 configured to neutralize the first or second odors 104 and 106 from the control center 100. Neutralization of the first or second odors 104 and 106 from the control center 100 can at least partially occur after the alert condition is eliminated. In such a manner, the neutralization system 112 may at least partially eliminate the first or second odors 104 and 106 after the alert condition is eliminated. In an embodiment, the neutralization system 112 can include an evacuation system configured to create a pressure differential and remove the first odor from the control center 100. Exemplary neutralization systems 112 may include fans, filters, compressors, pumps, fluid passageways, gas passageways, or any combination thereof. In an embodiment, the neutralization system 112 can include a neutralizing odor configured to neutralize at least the first and second odors 104 and 106.

Figure 2:
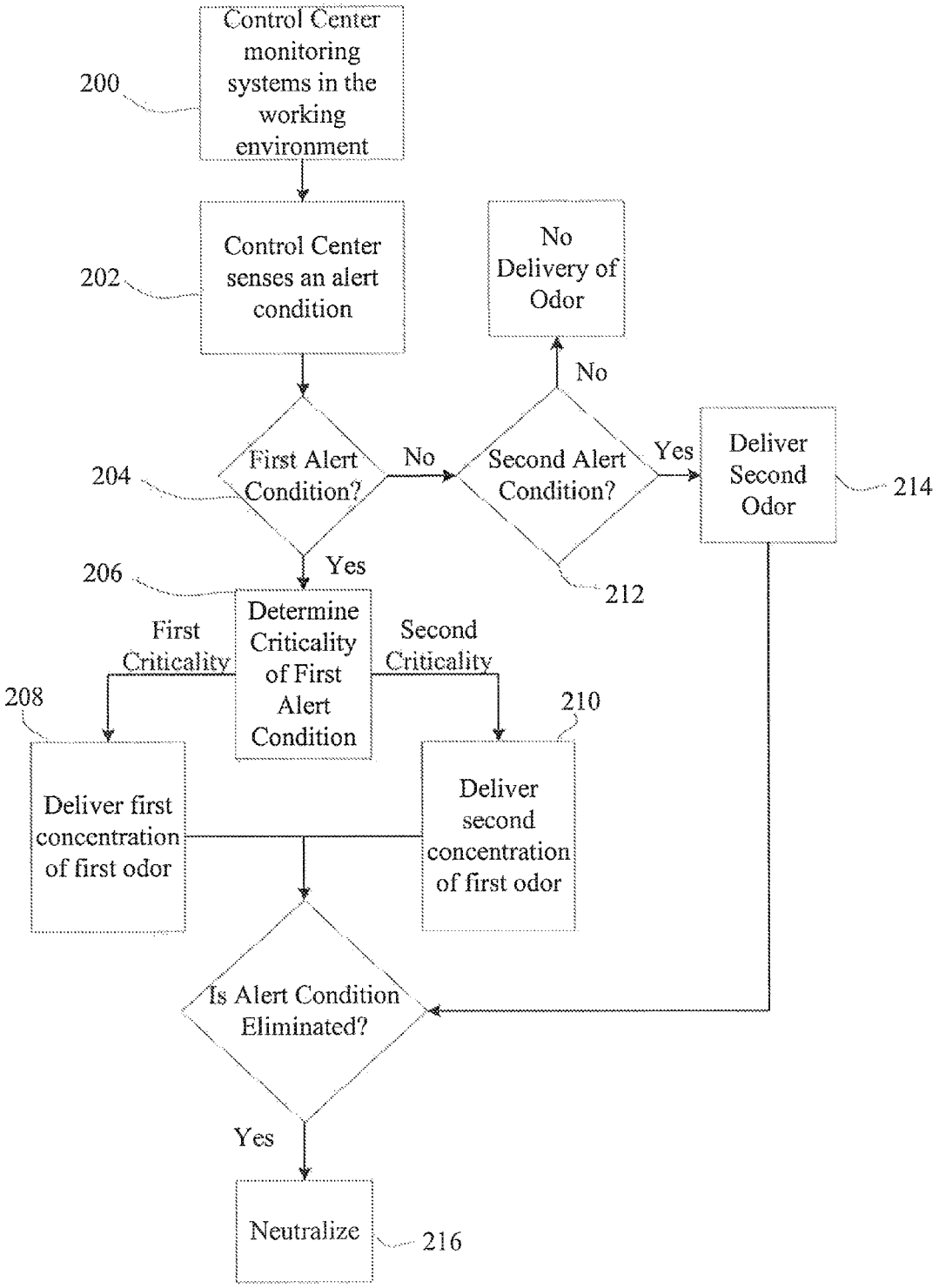
FIG. 2 includes a flow chart detailing one methodology of using the system in accordance with an embodiment.

In yet another embodiment, the neutralization system may be 112 can be configured to reset the first or second odors 104 and 106. Resetting of the first or second odors 104 and 106 can include cessation of the release of the first or second odors 104 and 106 into the control center. The cessation of the release of the first or second odors 104 and 106 can be an immediate termination of the release of the first or second odors 104 and 106. Alternatively, the resetting of the first and second odors 104 and 106 by the neutralization system can include a gradual decrease in the volume or concentration of the first or second odor 104 and 106 to the control center. The act of resetting the odors in the control center 100 by the neutralization system 112 can also incorporate the use of an evacuation system as noted above. The neutralization system 112 may further communicate with the controller 110 to facilitate control of the other alarms, including for example, but not limited to the auditory or visual alarm systems. Moreover, the FIG. 2 illustrates a flow chart detailing one methodology of using the system in accordance with an embodiment described herein. The system can generally monitor systems in the working environment at 200. The control center can actively monitor the systems in the working environment for predetermined conditions. The predetermined conditions can include a first condition having a first alert condition and a second condition having a second alert condition. It will be appreciated that the use of first alert condition and second alert condition is illustrative and the system can be adapted to control and monitor any number of various alert conditions in the working environment.

Upon sensing an alert condition at 202 the odor alarm system can determine whether the alert condition is the first alert condition at 204. Upon determining the presence of the first alert condition, the odor alarm system can then determine urgency, duration, or repetition criterion of the first alert condition at 206. If the urgency, duration, or repetition criterion is at a first threshold, the odor alarm system can deliver a first concentration, volume, or rate of the first odor at 208. If the urgency, duration, or repetition criterion is at a second threshold, the odor alarm system can deliver a second concentration, volume, or rate of the first odor at 210, the second concentration being different from the first concentration. In certain embodiments, where the second threshold has a higher urgency, duration, or repetition criterion than the first threshold, the second concentration, volume, or rate of the first odor may be greater than the first concentration, volume, or rate of the first odor and may be suitable at alerting the controller more rapidly than otherwise possible using the first concentration, volume, or rate of the first odor.

If, at 212, the odor alarm system determines the presence of the second alert condition, the odor alarm system can deliver a second odor to the control center at 214. The evaluation and delivery of the second odor can be conducted separately or simultaneously with delivery of the first odor. However, it will be appreciated that the evaluation and delivery of the second odor can be withheld in instances where a first odor has been delivered, including for example, conditions where the second odor is associated with a second alert condition having a lower urgency, duration, or repetition criterion as compared to the first alert condition. In a further embodiment, delivery of the second odor may be withheld until the first odor is neutralized. Yet, more particularly, the audio and visual alarm systems may be used to alert an operator of a critical condition while delivery of the second odor may be withheld until the first odor is neutralized. Upon effective neutralization of the first odor, the second odor may be delivered. At such time, the audio and visual alarm systems may be disengaged.

In a non-illustrated embodiment, and similar to delivery of the first odor, delivery of the second odor can be selectively adjusted dependent upon urgency, duration, or repetition criterion of the second alert condition. If the urgency, duration, or repetition criterion of the second alert condition is at a first threshold, the odor alarm system can deliver a first concentration, volume, or rate of the second odor. If the urgency, duration, or repetition criterion of the second alert condition is at a second threshold, the odor alarm system can deliver a second concentration, volume, or rate of the second odor, the second concentration being different from the first concentration. In certain embodiments, where the second threshold has a higher urgency, duration, or repetition criterion than the first threshold, the second concentration, volume, or rate may be greater than the first concentration, volume, or rate of the first odor.

At 216, responsive to the elimination of the first or second alert condition, the neutralization system can neutralize the first or second odor from the control center.

Many different aspects and embodiments are possible. Some of those aspects and embodiments are described below. After reading this specification, skilled artisans will appreciate that those aspects and embodiments are only illustrative and do not limit the scope of the present invention. Embodiments may be in accordance with any one or more of the items as listed below.

Item 1. A system comprising:

a working environment; and a control center separated from the working environment and configured to monitor systems in the working environment, the control center comprising an odor alarm system configured to deliver at least a first odor to the control center and alert an operator to an alert condition.

Item 2. The system of item 1, wherein the control center is a remotely located from the working environment.

Item 3. The system of item 1, wherein the control center comprises a virtual display of actions in the working environment.

Item 4. The system of item 1, wherein the working environment includes a system for conducting subterranean operations.

Item 5. The system of item 4, wherein the control center is an enclosed cabin on a drill rig.

Item 6. The system of item 4, wherein the control center is a virtual monitoring center configured to monitor the actions of the working environment via wireless communication.

Item 7. The system of item 4, wherein the control center is configured to monitor the actions of the working environment via wired communication.

Item 8. The system of item 4, wherein the working environment includes a drilling rig.

Item 9. The system of item 1, wherein the systems of the working environment include at least a mud pump, a top drive, at least one pressurized system, a detection system, power units, and a combination thereof.

Item 10. The system of item 1, wherein the working environment is an industrial working site.

Item 11. The system of item 1, wherein the working environment is a substantially automated industrial worksite.

Item 12. The system of item 1, wherein the first odor is associated with a first alarm condition.

Item 13. The system of item 12, wherein the odor alarm system comprises a second odor associated with a second alarm condition, wherein the first alarm condition is different than the second alarm condition.

Item 14. The system of item 13, wherein the first odor is different than the second odor.

Item 15. The system of item 13, wherein the odor alarm system is configured to deliver one of a select volume of the first odor, a select concentration of the first odor, or a rate of the first odor based upon at least one of an urgency criterion associated with the alarm condition, a duration criterion associated with the alarm condition, and a repetition criterion associated with the alarm condition.

Item 16. The system of item 1, wherein the odor alarm system comprises at least one odor-containing capsule configured to contain the first odor, a delivery mechanism configured to deliver the first odor to the control center, a controller coupled to the odor alarm system and a monitoring system, wherein the controller is configured to transmit an odor delivery signal to the odor alarm system upon receiving an alarm condition from the monitoring system.

Item 17. The system of item 1, wherein the control center further comprises one or more visual or audio alarm systems configured to alert the controller to an alarm condition.

Item 18. The system of item 17, wherein the odor alarm system is configured to be used in conjunction with the one or more visual or audio alarm systems.

Item 19. The system of item 1, further comprising neutralization system configured to neutralize the first odor from the control center.

Item 20. The system of item 19, wherein the neutralization system is configured to at least partially eliminate the first odor from the control center after the alert condition is eliminated.

Item 21. The system of item 19, wherein the neutralization system comprises an evacuation system configured to create a pressure differential and remove the first odor from the control center.

Item 22. The system of item 1, wherein the first odor is selected from the group of a pleasant odor or an unpleasant odor.

Item 23. The system of item 22, wherein a concentration of the first odor in the control center is dependent upon a criticality level associated with the alert condition.

Item 24. The system of item 24, wherein the first odor has a first concentration for a first criticality level and a second concentration for a second criticality level, wherein the first criticality level is higher than the second criticality level and the first concentration is higher than the second concentration.

Item 25. The system of item 1, wherein the control center further comprises at least one of an audio alarm system, a visual alarm system.

Item 26. The system of item 25, wherein the odor alarm system is configured to work in conjunction with the audio alarm system.

Item 27. The system of item 25, wherein the odor alarm system is configured to work in conjunction with the visual alarm system.

Item 28. The system of item 25, wherein the odor alarm system is configured to be activated after a failure signal is generated by the controller for failure of an operator to respond to at least one of a visual alarm or audio alarm.

Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. A system comprising:

a working environment; and a control center separated from the working environment and configured to monitor systems in the working environment, the control center comprising an odor alarm system configured to alert an operator at the control center by releasing at least a first odor into the control center in response to an occurrence of an alert condition at the working environment, wherein the alert condition comprises a critical condition or a dangerous condition.

2. The system of claim 1, wherein the control center is a remotely located from the working environment.

3. The system of claim 1, wherein the control center comprises a virtual display of actions in the working environment.

4. The system of claim 1, wherein the working environment includes a system for conducting subterranean operations.

5. The system of claim 4, wherein the control center is an enclosed cabin on a drill rig.

6. The system of claim 4, wherein the control center is a virtual monitoring center configured to monitor the actions of the working environment via wireless communication.

7. The system of claim 4, wherein the control center is configured to monitor the actions of the working environment via wired communication.

8. The system of claim 4, wherein the working environment includes a drilling rig.

9. The system of claim 1, wherein the systems of the working environment include at least a mud pump, a top drive, at least one pressurized system, a detection system, power units, and a combination thereof.

10. The system of claim 1, wherein the working environment is an industrial working site.

11. The system of claim 1, wherein the working environment is a substantially automated industrial worksite.

12. The system of claim 1, wherein the first odor is associated with a first alert condition.

13. The system of claim 12, wherein the odor alarm system comprises a second odor associated with a second alert condition, wherein the first alert condition is different than the second alert condition.

14. The system of claim 13, wherein the first odor is different than the second odor.

15. The system of claim 13, wherein the odor alarm system is configured to release one of a select volume of the first odor, a select concentration of the first odor, or a rate of the first odor based upon at least one of an urgency criterion associated with the alert condition, a duration criterion associated with the alert condition, and a repetition criterion associated with the alert condition.

16. The system of claim 1, wherein the odor alarm system comprises at least one odor-containing capsule configured to contain the first odor, a delivery mechanism configured to release the first odor into the control center, a controller coupled to the odor alarm system and a monitoring system, wherein the controller is configured to transmit an odor delivery signal to the odor alarm system upon receiving an alert condition from the monitoring system.

17. The system of claim 1, wherein the control center further comprises one or more visual or audio alarm systems configured to alert the controller to an alert condition.

18. The system of claim 17, wherein the odor alarm system is configured to be used in conjunction with the one or more visual or audio alarm systems.

19. The system of claim 1, further comprising neutralization system configured to neutralize the first odor from the control center.

20. The system of claim 19, wherein the neutralization system is configured to at least partially eliminate the first odor from the control center after the alert condition is eliminated.

* * * * *